US011849876B2

(12) United States Patent
Lee

(10) Patent No.: US 11,849,876 B2
(45) Date of Patent: Dec. 26, 2023

(54) PILLOW WITH ROD-SHAPED INSERT

(71) Applicant: Ryan Lee, Fort Lee, NJ (US)

(72) Inventor: Ryan Lee, Fort Lee, NJ (US)

( * ) Notice: Subject to any disclaimer, the term of this patent is extended or adjusted under 35 U.S.C. 154(b) by 0 days.

(21) Appl. No.: 18/111,937

(22) Filed: Feb. 21, 2023

(65) Prior Publication Data

US 2023/0210282 A1 Jul. 6, 2023

Related U.S. Application Data

(63) Continuation-in-part of application No. 17/578,711, filed on Jan. 19, 2022.

(51) Int. Cl.
*A47G 9/10* (2006.01)
*A47G 9/02* (2006.01)

(52) U.S. Cl.
CPC ..... *A47G 9/1009* (2013.01); *A47G 9/0253* (2013.01)

(58) Field of Classification Search
CPC ..... A47C 27/146; A47C 27/148; A47G 2009/1018
See application file for complete search history.

(56) References Cited

U.S. PATENT DOCUMENTS 2,750,606 A * 6/1956 Freedlander ..... A47G 9/10 5/636
4,070,719 A 1/1978 Morgan
4,754,513 A 7/1988 Rinz
4,821,355 A 4/1989 Burkhardt
4,829,614 A * 5/1989 Harper ..... A47G 9/1081 5/636
4,908,894 A 3/1990 Sanders
4,916,765 A * 4/1990 Castronovo, Jr. .... A47G 9/1081 5/636
4,959,880 A 10/1990 Tesch
5,014,377 A 5/1991 Dixon
(Continued)

FOREIGN PATENT DOCUMENTS

AT 6451 U1 * 11/2003
CN 110448119 A * 11/2019
(Continued)

OTHER PUBLICATIONS

U.S. Pat. No. 655,087 to Jones, published Jul. 31, 1900 [listed here as the USPTO auto-fill form does not accept six digit patent numbers].

*Primary Examiner* — Eric J Kurilla
(74) *Attorney, Agent, or Firm* — Michael J. Feigin, Esq.; Feigin and Fridman

(57) ABSTRACT

A pillow with a removable rod-shaped insert is described herein. The rod-shaped insert is removably insertable into a cavity and/or trough within the pillow. Both the rod-shaped insert and the cavity and/or trough are substantially semi-circular at each vertically oriented cross-section thereof. The cavity includes an opening in a side of the pillow opposite a side thereof which is in contact with a user's head and/or body. The rod-shaped insert has a plurality of parallel ridges on at least one outer surface thereof and extends between both lateral sides of the pillow. In some configurations, the rod-shaped insert is a single substantially planar structure which is folded into a substantially semi-circular shape. In some configurations, the rod-shaped insert has an internal removably-insertable structure.

5 Claims, 7 Drawing Sheets

(56) References Cited

U.S. PATENT DOCUMENTS

| | | | | |
|---|---|---|---|---|
| D321,562 | S | 11/1991 | Ljungvall | |
| D328,682 | S | 8/1992 | Carney | |
| 5,247,714 | A * | 9/1993 | Lipps | A47C 27/15 5/733 |
| 5,474,362 | A | 12/1995 | Albecker, III | |
| 5,533,218 | A * | 7/1996 | Fahy | A47C 27/16 5/636 |
| 5,682,633 | A * | 11/1997 | Davis | A47G 9/1081 5/636 |
| 6,704,958 | B2 * | 3/2004 | Gohl | A47G 9/1045 5/639 |
| 6,823,546 | B1 * | 11/2004 | Hsu | A61H 7/001 5/639 |
| 6,952,848 | B1 * | 10/2005 | Strunk-Fellows | A47G 9/10 5/636 |
| 7,013,512 | B1 * | 3/2006 | Hsu | A47G 9/1081 5/636 |
| 7,434,281 | B1 | 10/2008 | Holliday et al. | |
| 7,594,288 | B1 * | 9/2009 | Holliday | A47G 9/10 5/636 |
| 8,782,835 | B2 * | 7/2014 | Pozzi | B64D 11/06 244/118.6 |
| 9,247,836 | B2 | 2/2016 | DuPre | |
| 9,462,902 | B1 | 10/2016 | Rukel | |
| 9,756,951 | B1 * | 9/2017 | Stewart, Jr. | A47C 19/025 |
| D883,713 | S | 5/2020 | Glatt | |
| 10,647,434 | B2 * | 5/2020 | Hessenberger | B64D 11/0647 |
| 10,820,718 | B1 * | 11/2020 | Hall | A47G 9/10 |
| 10,881,226 | B1 | 1/2021 | Ou | |
| 10,905,265 | B1 * | 2/2021 | Warner | A47G 9/007 |
| 10,932,587 | B2 | 3/2021 | Poppe | |
| 11,006,762 | B2 * | 5/2021 | Stewart, Jr. | A47C 19/025 |
| 2004/0139548 | A1 | 7/2004 | Hwang-Pao | |
| 2008/0134439 | A1 * | 6/2008 | Ricalde | A47G 9/10 5/636 |
| 2011/0094033 | A1 * | 4/2011 | Lee | A47G 9/109 5/636 |
| 2012/0065557 | A1 | 3/2012 | Phillips | |
| 2014/0283305 | A1 * | 9/2014 | Zysman | A47C 27/148 5/636 |
| 2016/0296031 | A1 * | 10/2016 | Sramek | A61F 5/56 |
| 2021/0337991 | A1 * | 11/2021 | Smith, Sr. | A47G 9/1081 |

FOREIGN PATENT DOCUMENTS

| | | | | |
|---|---|---|---|---|
| CN | 111265078 | A * | 6/2020 | |
| CN | 111700454 | A * | 9/2020 | |
| CN | 112056894 | A * | 12/2020 | |
| CN | 112471848 | A * | 3/2021 | A47G 9/10 |
| CN | 112842031 | A * | 5/2021 | A47G 9/1036 |
| CN | 113171252 | A * | 7/2021 | |
| CN | 113336914 | A * | 9/2021 | |
| CN | 214230757 | U * | 9/2021 | |
| CN | 113461898 | A * | 10/2021 | |
| CN | 115067722 | A * | 9/2022 | |
| CN | 115191805 | A * | 10/2022 | |
| WO | WO-2015085374 | A2 * | 6/2015 | A47G 9/10 |
| WO | WO-2022250329 | A1 * | 12/2022 | |

* cited by examiner

PILLOW WITH ROD-SHAPED INSERT

FIELD OF THE DISCLOSED TECHNOLOGY

The disclosed technology relates to pillows, and more specifically to pillows with inserts for correcting pain.

BACKGROUND

Neck pain plagues a significant amount of people. One common method of treating this pain is through use of a specialized pillow, such as one which provides a higher level of firmness or contains massaging ridges. Unfortunately, these pillows may be expensive, and one may be required to purchase multiple pillows to accommodate variations within one's own sleeping pattern.

Thus, there is a need for a single pillow capable of being adapted for varying pain treatment needs. This and other problems are solved by embodiments of the disclosed technology, as described below.

SUMMARY OF THE DISCLOSED TECHNOLOGY

A therapeutic pillow of embodiments of the disclosed technology includes a pillow with a trough therein, and a removably insertable insert. The trough extends linearly across a longest horizontal extent of a bottom side of the pillow. The insert has a rounded surface corresponding to a shape of the trough, and is removably insertable into the trough. An area circumscribed by the trough and by an opening thereof is substantially in a shape of a semi-circular prism. A distance between a deepest point of the trough and the bottom side is substantially less than half of a distance between, and substantially more than a third of a distance between, a top side of the pillow and the bottom side thereof.

In some embodiments, the pillow is in a shape of a rounded rectangular prism. Its top and bottom sides may be opposite each other, and may be largest sides of the rounded rectangular prism. A majority of bottom top side, in embodiments, extends on a first side of the trough, while a minority thereof extends on a second side of the trough.

In various embodiments, when the insert is removably inserted within the trough, a top-most portion of thereof is substantially flush with the deepest point of the trough and a bottom-most portion thereof is substantially parallel with the top side of the pillow.

In various embodiments of the disclosed technology, substantially every vertical cross-section of the insert is in a shape of a semicircle. Each semi-circular shape may include two extended legs with a curved portion there-between. Every said vertical cross-section of the insert, in embodiments, is in a plane substantially perpendicular to a plane of the top and/or bottom side and/or each of longer lateral sides of the pillow, and substantially parallel to a plane of each of shorter lateral sides of the pillow.

A height of the trough may be substantially equal to a height of the insert. Furthermore, a shape of the trough may substantially correspond to a shape of the insert, allowing the insert to be insertable within said trough such that substantially every part thereof is surrounded by the trough and/or the opening thereof within a plane of the bottom side of the pillow.

The "height" of the trough is defined as a distance, in a plane parallel to the left and right sides of the pillow, between a point of the trough closest to the top side of the pillow and a central point of an opening of the trough within the bottom side of the pillow. The "height" of the insert is defined as a distance, in a plane parallel to the left and right sides of the pillow when the insert is inserted within the trough, between a point of the insert closest to a point of the trough closest to the top side of the pillow and a point substantially between a most-extended point of each extended leg.

In some embodiments, a most-extended point of each extended leg of the insert contacts a surface opposite a user's head at at least one point thereof while the user's head rests on the therapeutic pillow. In further embodiments, a most-extended point of each extended leg of the insert is configured to contact a surface opposite a user's neck at at least one point thereof while the user's head rests on the therapeutic pillow.

The insert may be made of and/or include foam, and may be textured such that the insert remains stationary relative to the therapeutic pillow while unequal pressure is applied to each of the extended legs resulting from friction between the textured surface of the insert and the surface of the trough.

In embodiments of the disclosed technology, a face of the pillow which includes the trough is substantially smooth but for the trough. In other embodiments, a face of the pillow containing the trough is substantially smooth but for the trough and for indicia on the pillow.

In some embodiments, the above-described therapeutic pillow further includes a pillowcase with a trough and a zipper. The pillowcase trough may substantially correspond in size and shape to the trough of the pillow. A distance between the zipper and a face of the pillowcase which includes the trough is, in some embodiments, greater than a distance between the zipper and a face of the pillowcase opposite the face containing the trough.

A radius of curvature of edges of the top side may be smaller than a radius of curvature of edges of the bottom side.

The insert, in various embodiments, is configured to contact a surface opposite a user's head at at least one point thereof while the user's head rests on the therapeutic pillow.

Described differently, a therapeutic pillow kit includes a pillow, a pillowcase, and a plurality of inserts. The pillow contains a linear hollow in a shape of a prism. The pillowcase has a sleeve in a location thereon corresponding to a location of the linear hollow. The inserts have shapes partially or wholly corresponding to the shape of the linear hollow. The sleeve is configured to accommodate each of the inserts, and each insert is removably insertable into each of the linear hollow and the sleeve.

Each insert, in some embodiments, is in a shape of a ridged and/or smooth triangular and/or semi-circular prism. In other embodiments, each insert is in a shape of a rectangular prism with substantially identical folds at each vertical cross section thereof. "Vertical" is defined as a plane substantially parallel to both the right side and the left side of the pillow when the insert is removably inserted within the trough. Furthermore, each insert may have a hollow portion at each vertical cross section thereof. In various embodiments, each insert includes an internal linear hollow in a shape of a prism, and an internal insert removably insertable therein. The internal insert may be made of a same and/or a different material as the insert, and a same internal insert may be usable for multiple inserts.

Any device or step to a method described in this disclosure can comprise or consist of that which it is a part of, or the parts which make up the device or step. The term "and/or" is inclusive of the items which it joins linguistically and each item by itself.

DETAILED DESCRIPTION OF EMBODIMENTS OF THE DISCLOSED TECHNOLOGY

A pillow with a removable rod-shaped insert is described herein. The rod-shaped insert is removably insertable into a cavity and/or trough within the pillow. Both the rod-shaped insert and the cavity and/or trough are substantially semi-circular at each vertically oriented cross-section thereof. The cavity includes an opening in a side of the pillow opposite a side thereof which is in contact with a user's head and/or body. The rod-shaped insert has a plurality of parallel ridges on at least one outer surface thereof and extends between both lateral sides of the pillow.

In some configurations, the rod-shaped insert is a single substantially planar structure which is folded into a substantially semi-circular shape. In some configurations, the rod-shaped insert has an internal removably-insertable structure.

Embodiments of the disclosed technology will become more clear in view of the following discussion of the figures.

Figure 1:
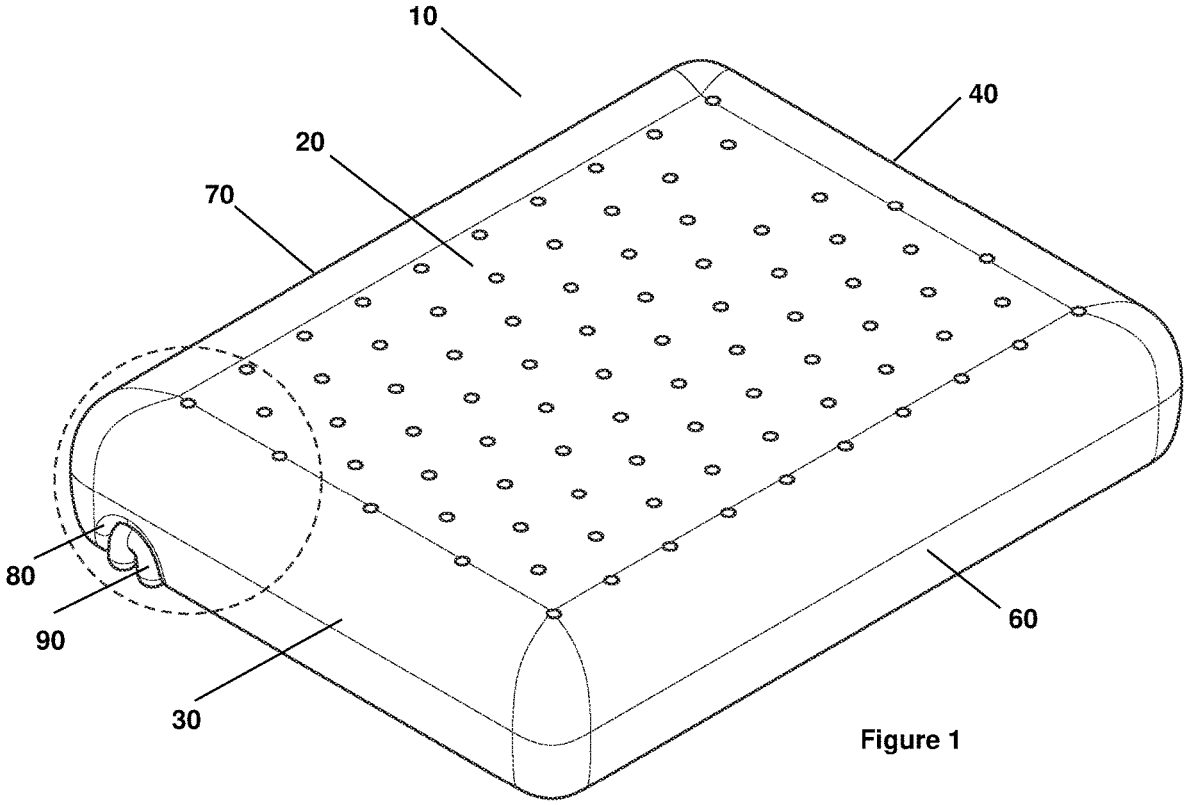
FIG. 1 shows a top and left perspective view of a therapeutic pillow and insert of embodiments of the disclosed technology.
Figure 2:
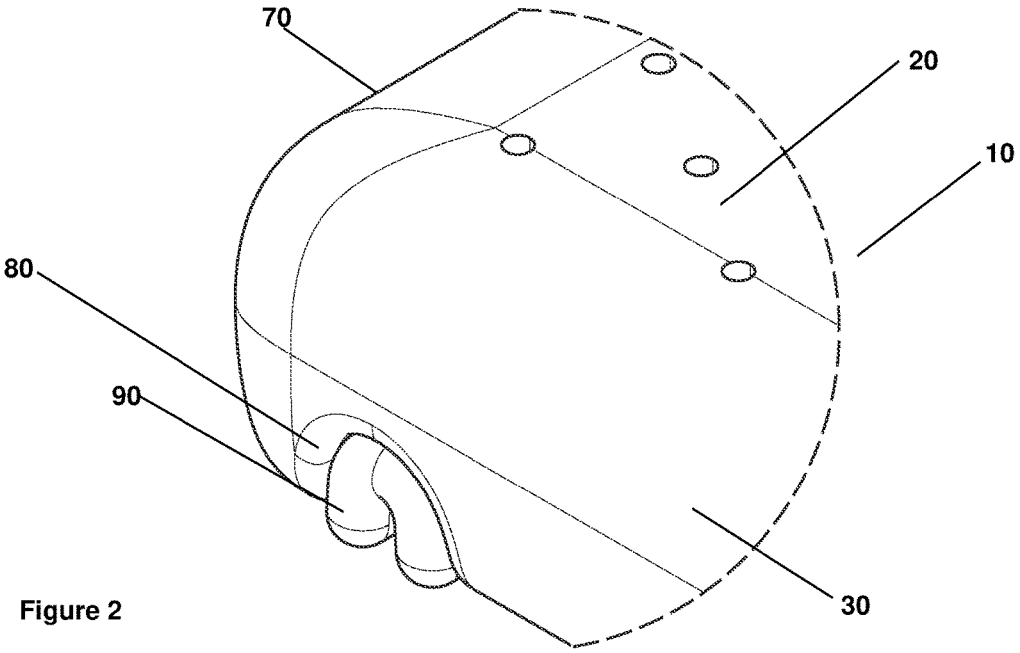
FIG. 2 shows a top and left cutaway perspective view thereof.
Figure 3:
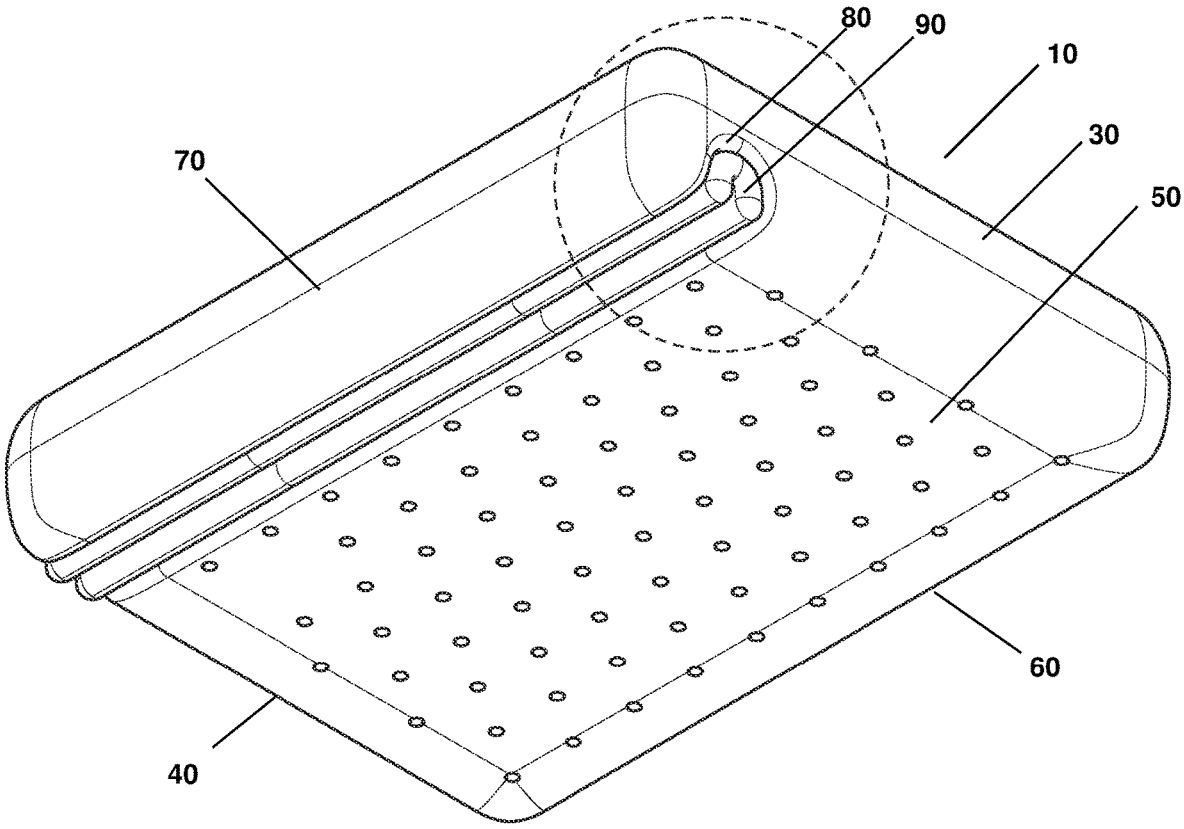
FIG. 3 shows a bottom and right perspective view thereof.
Figure 4:
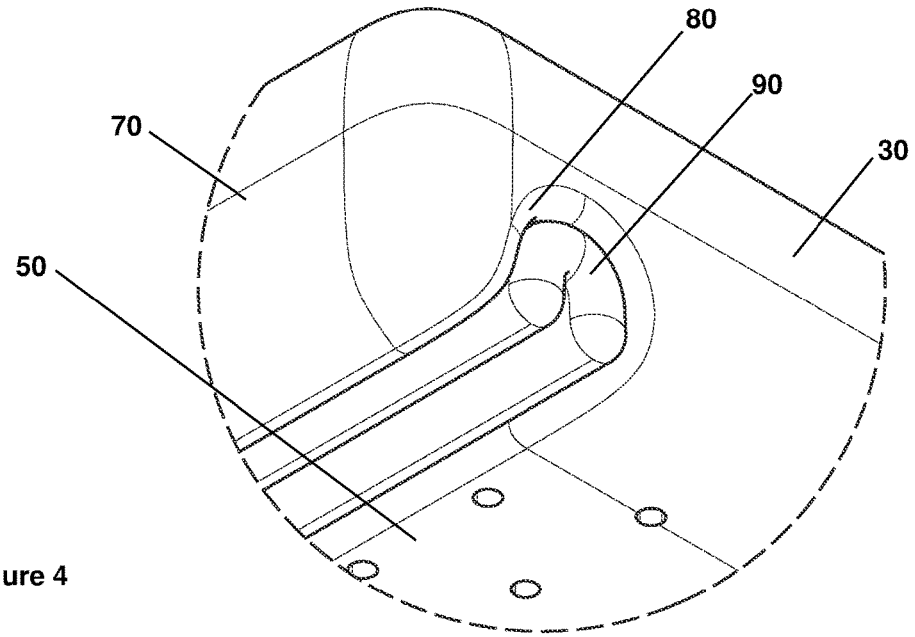
FIG. 4 shows a bottom and right cutaway perspective view thereof.

FIG. 1 shows a top and left perspective view of a therapeutic pillow and insert of embodiments of the disclosed technology. FIG. 2 shows a top and left cutaway perspective view thereof. FIG. 3 shows a bottom and right perspective view thereof. FIG. 4 shows a bottom and right cutaway perspective view thereof. The pillow 10, as shown, is in a shape of a rectangular prism with rounded edges and corners. The pillow 10 is compressible along substantially any axis passing there-through. A top surface 20 of the pillow 10 is substantially seamlessly connected to rounded corners and edges at each edge and each corner thereof.

The pillow 10 has a left side 30 and a right side 40, each of which include a substantially planar section at a substantial midpoint between the top side 20 and a bottom side 50. The substantially planar sections are substantially opposite each other and are substantially parallel to each other. An upper portion of each of left side 30 and right side 40 (defined as a portion thereof which is relatively close and/or adjacent to top side 20) is connected substantially seamlessly to top side 20 by way of a rounded edge.

The pillow 10 has a front side 60 and a back side 70, each of which include a substantially planar section at a substantial midpoint between the top side 20 and the bottom side 50. The substantially planar sections are substantially opposite each other and are substantially parallel to each other. An upper portion of each of front side 60 and back side 70 (defined as a portion thereof which is relatively close and/or adjacent to top side 20) is connected substantially seamlessly to top side 20 by way of a rounded edge. A left-most side of each of front side 60 and back side 70 (defined as a portion thereof which is relatively close and/or adjacent to left side 30) is connected substantially seamlessly to left side 30 by way of a rounded corner. A right-most side of each of front side 60 and back side 70 (defined as a portion thereof which is relatively close and/or adjacent to right side 40) is connected substantially seamlessly to left side 40 by way of a rounded corner.

The bottom side 50 of the pillow 10 has a trough 80, with an insert 90 removably insertable therein. The trough 80 is in a substantial shape of a semi-circular prism extending linearly along a line substantially parallel to each of front size 60 and back size 70. The trough 80 is substantially uniformly shaped throughout, such that substantial each cross section thereof in a plane parallel to left side 30 and right side 40 is of a substantially same semi-circular shape. The tough 80 includes an opening within bottom side 50 corresponding to a substantially widest section of each semi-circular cross-section. The trough 80 further includes a semi-circular opening on a left-most side and a right-most side thereof within left side 30 and right side 40.

A lower portion of each of front side 60 and back side 70 (defined as a portion thereof which is relatively close and/or adjacent to bottom side 50) is connected substantially seamlessly to bottom side 50 by way of a rounded edge. A lower portion of each of left side 30 and right side 40 (defined as a portion thereof which is relatively close and/or adjacent to bottom side 50) is connected substantially seamlessly to bottom side 50 and/or the opening on the respective side of trough 80 by way of a rounded edge.

Figure 5:
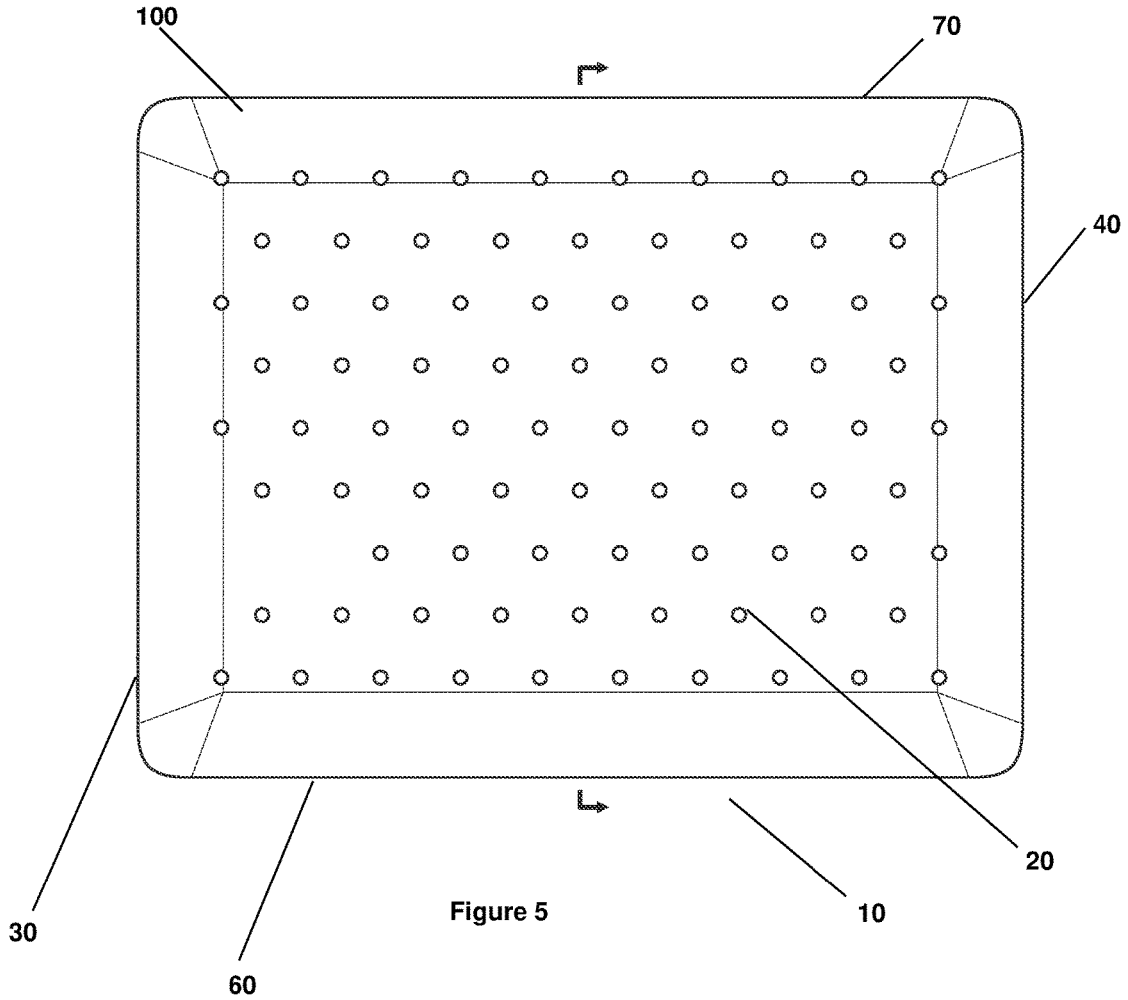
FIG. 5 shows a top plan of a therapeutic pillow, pillowcase, and insert of embodiments of the disclosed technology.
Figure 6:
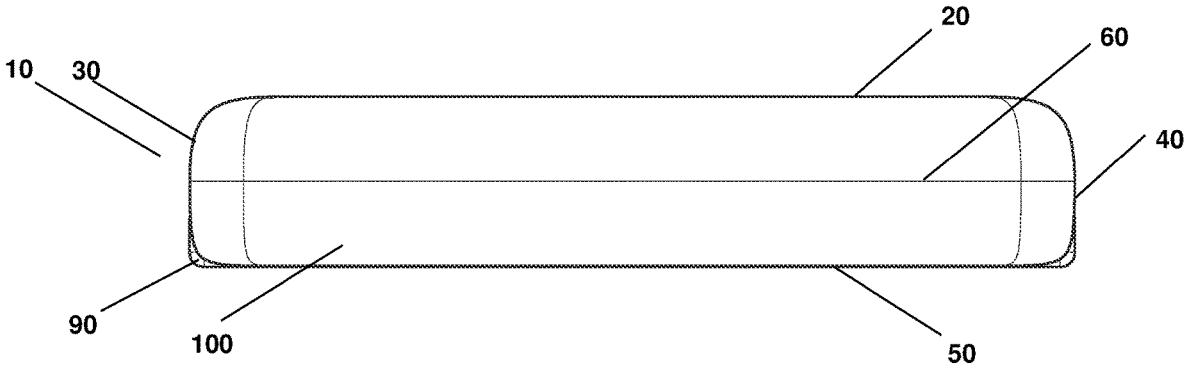
FIG. 6 shows a front elevation view thereof.

FIGS. 5 through 8 show the insert within the trough. FIG. 5 shows a top plan of a therapeutic pillow, pillowcase, and insert of embodiments of the disclosed technology. FIG. 6 shows a front elevation view thereof. A pillowcase 100, in the embodiment shown in FIG. 5, surrounds a substantial majority of the pillow 10 and the insert 90. The pillowcase 100, in the embodiment shown in FIG. 6, surrounds a substantial majority of the pillow 10 and extends within the trough 80, such that the insert 90 is removably insertable within the trough 90 while remaining external to the pillowcase 100.

In various embodiments, the pillowcase 100, or a minority portion thereof, may be made of a resilient and stretchable material, such that a portion of the pillowcase 100 corresponding to the bottom side 50 is substantially planar when the pillowcase 100 covers the pillow 10 in isolation, is substantially reversibly stretched outwardly when the pillowcase 100 covers the pillow 10 and the insert 90 (such that the respective portion pillowcase 100 is still capable of and adapted to be lying substantially planarly against the bottom side 50 when the pillowcase 100 covers the pillow 10 in isolation), and is substantially reversibly stretched inwardly when the pillowcase 100 covers the pillow 10 and the insert 90 is inserted within the trough 80 externally thereto (such that the respective portion pillowcase 100 is still capable of lying substantially planarly against the bottom side 50 when the pillowcase 100 covers the pillow 10 in isolation).

In other embodiments, the pillowcase 100 is configured such that a portion thereof corresponding to the trough 80 lies substantially flat there-against when the pillowcase 100 surrounds the pillow 10, regardless of the whether the insert 90 has been inserted into the trough 80. In some embodiments, the pillowcase includes holes corresponding to sides of the trough 80 within the left side 30 and/or the right side 40, such that the insert 90 may be removably inserted within the trough 80 and the pillowcase 100 while the pillowcase 100 surrounds the pillow 10.

Figure 7:
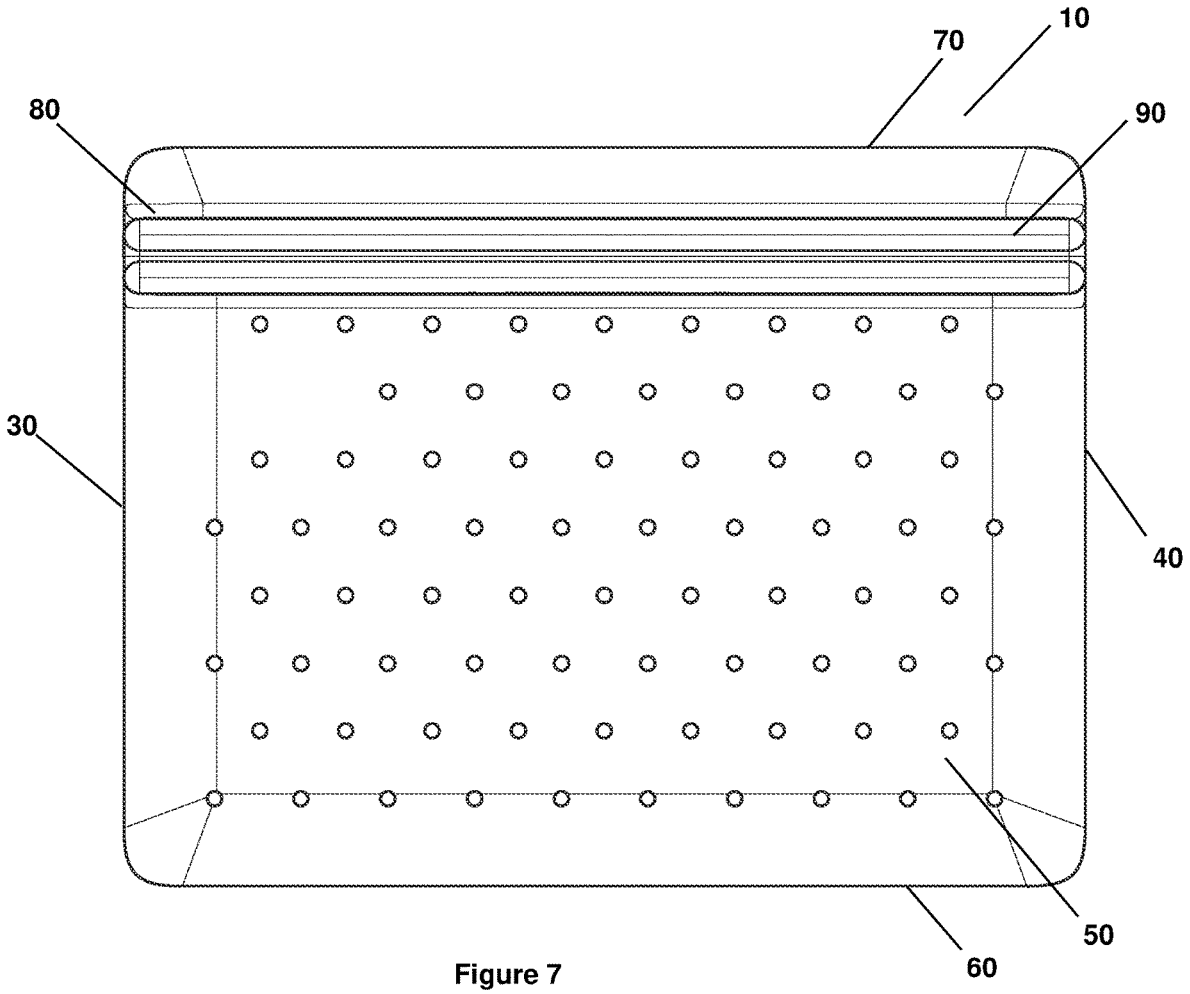
FIG. 7 shows a bottom plan of a therapeutic pillow and insert of embodiments of the disclosed technology.
Figure 8:
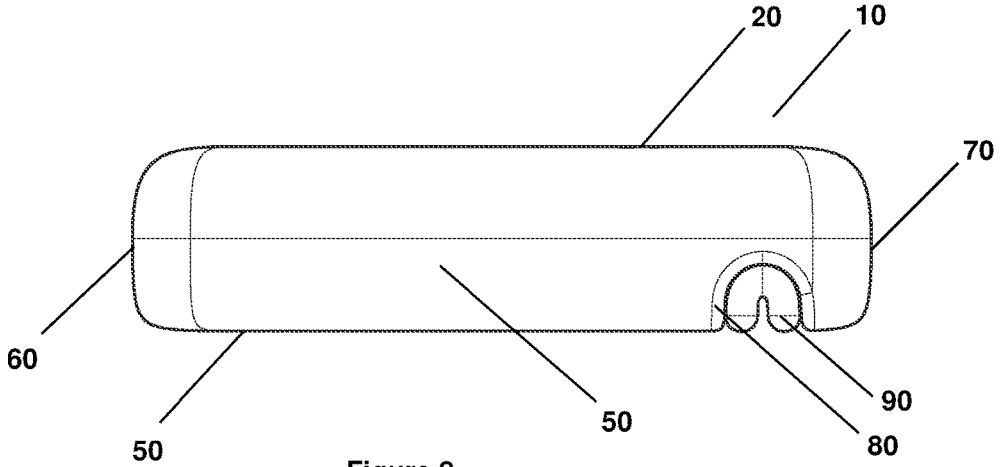
FIG. 8 shows a right side elevation view thereof.

FIG. 7 shows a bottom plan of a therapeutic pillow and insert of embodiments of the disclosed technology. In the embodiment shown the insert 90. In the embodiment shown, the insert 90 is configured to lie within the trough 80 such that substantially no part of the insert 90 extends outwardly past a plane of a bottom side 50 of the pillow 10. In other embodiments, the insert 90 may be configured to lie within the trough 80 such that a substantial minority of the insert 90 extends outwardly past a plane of a bottom side 50 of the pillow 10. The insert 90 may further be reversibly compressible such that the insert 90, when compressed by normal force of a person lying and/or sitting on the insert 90 or a combination of the insert 90 and the pillow 10, substantially no part of the insert 90 extends outwardly past a plane of a bottom side 50 of the pillow 10.

Figure 9:
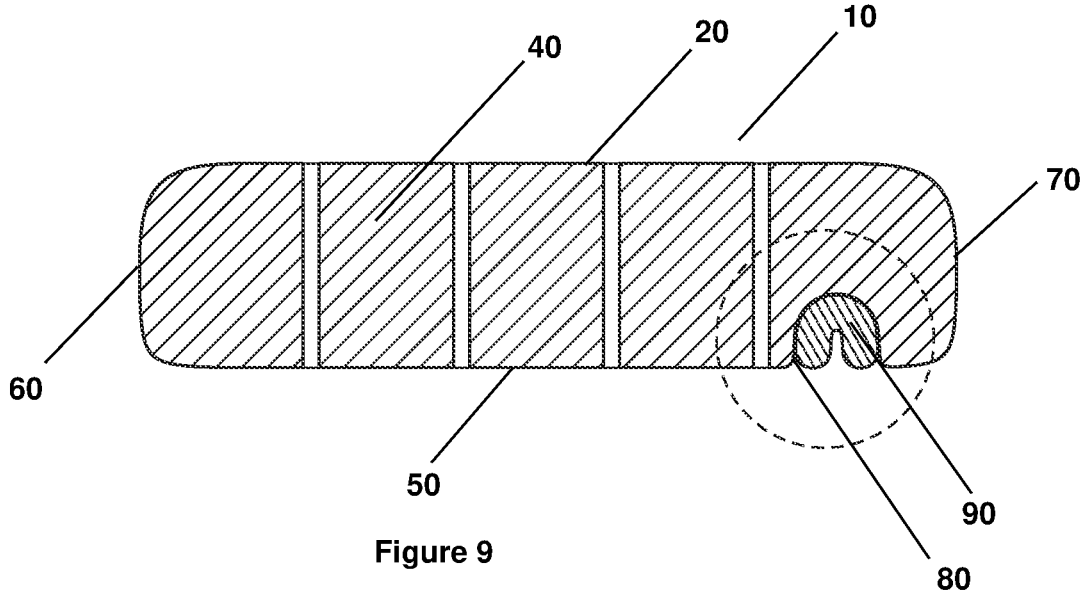
FIG. 9 shows a right side cross-sectional elevation view thereof.
Figure 10:
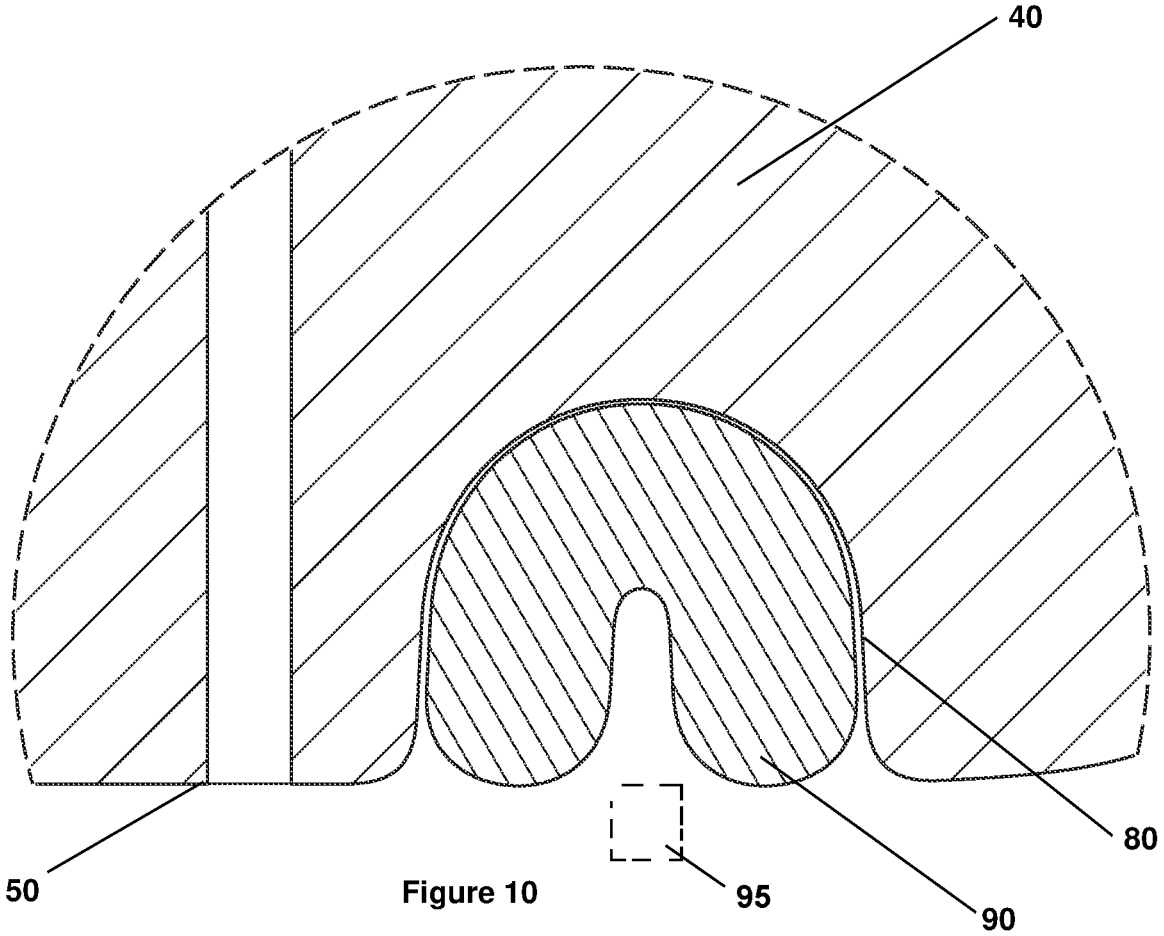
FIG. 10 shows a right side cross-sectional elevation cutaway view thereof.
Figure 11:
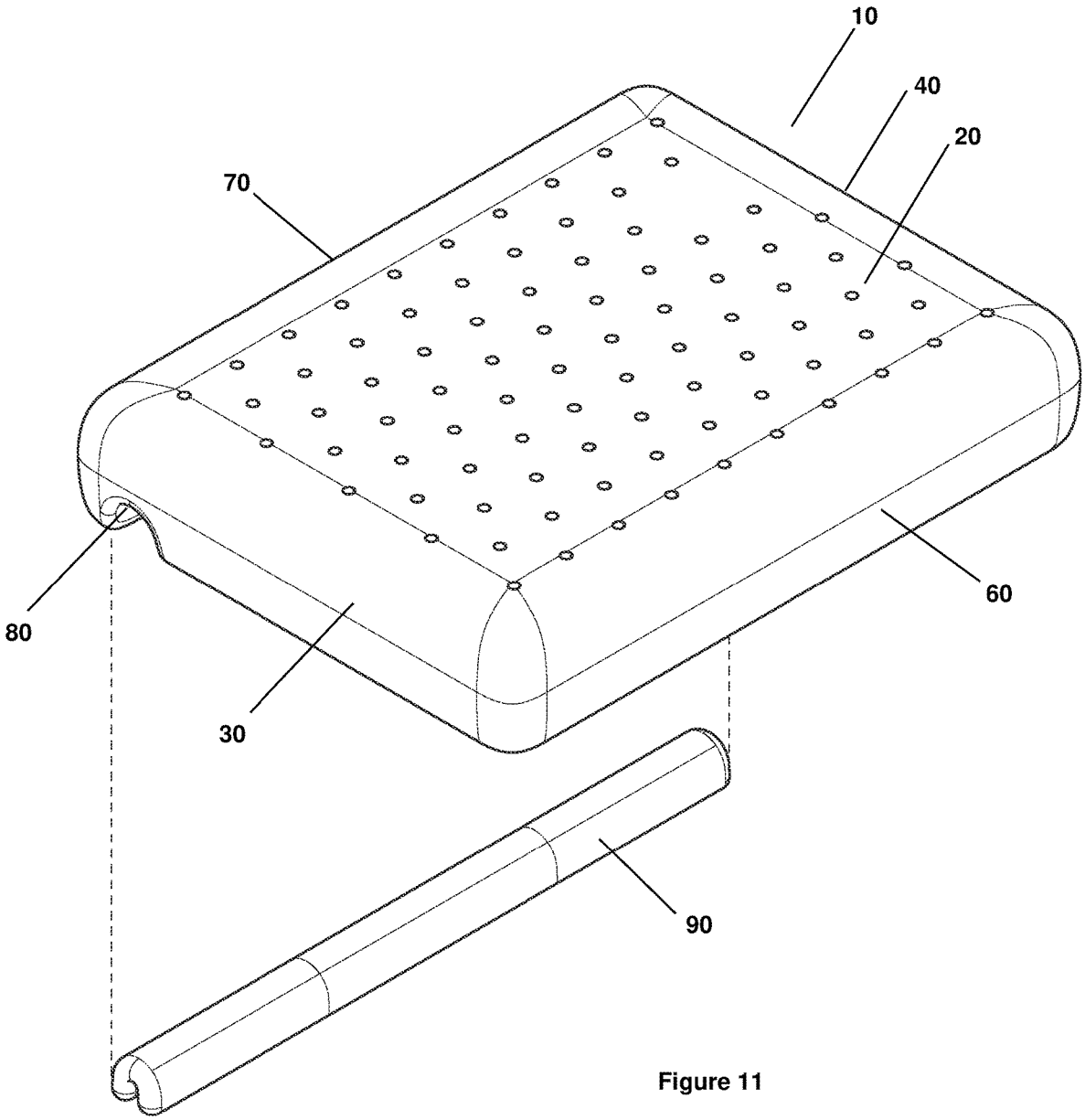
FIG. 11 shows a top and left perspective view of a therapeutic pillow and separated insert of embodiments of the disclosed technology.
Figure 12:
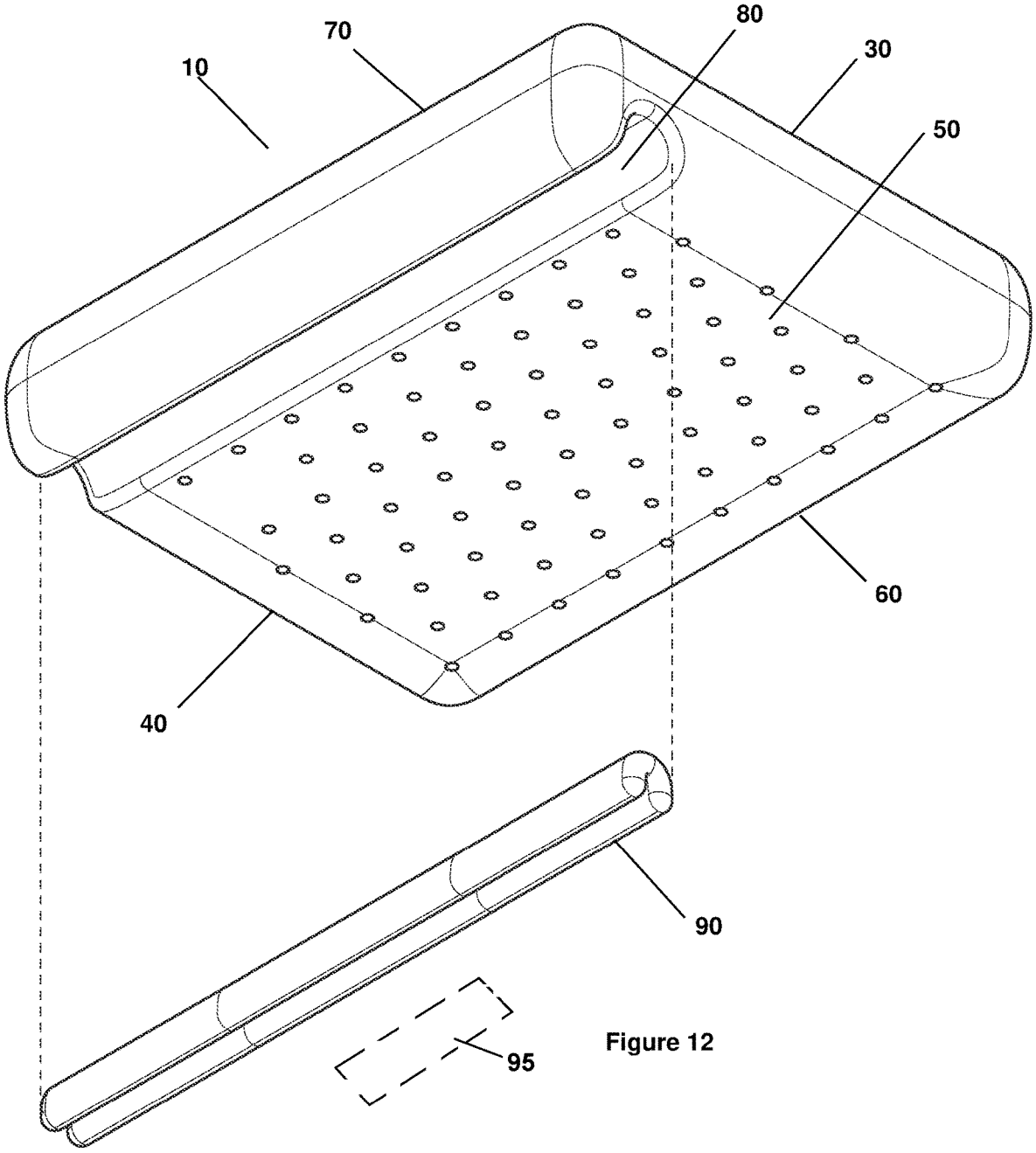
FIG. 12 shows a bottom and right perspective view thereof.

FIG. 9 shows a right side cross-sectional elevation view thereof. FIG. 10 shows a right side cross-sectional elevation cutaway view thereof. FIG. 11 shows a top and left perspective view of a therapeutic pillow and separated insert of embodiments of the disclosed technology. FIG. 12 shows a bottom and right perspective view thereof. In the embodiment shown, the insert 90 is in a shape of a substantially planar structure folded to form a substantially semi-circular shape. This semi-circular shape substantially corresponds to that of an internal surface of the trough 80. In other embodiments, the insert 90 may be substantially any shape, or a substantially planar structure folded in substantially any shape, such that the insert 90 fits within the semi-circular shape of the internal surface of the trough 80.

The insert 90, in the embodiment shown, has a substantially smooth surface at all points thereof. In other embodiments, the insert 90 may have protrusions, such as grooves, spikes, or bumps, or any combination thereof, as necessary for therapeutic and/or massage purposes. In further embodiments, the insert 90 may have an inner insert 95 and a plurality of outer inserts, such that each outer insert is attachable to the inner insert 95, and each combination of inner and outer insert is removably insertable within the trough 80.

The insert 90, in embodiments of the disclosed technology, is made of a material with a greater rigidity than a material of the pillow 10 and/or of a lower compressibility than a material of the pillow 10. In some embodiments, when the insert 90 is inserted within the trough 80, a half of the pillow 10 that surrounds the trough 80 and the insert 90 has a greater rigidity than the rest of the pillow 10. In other embodiments, when the insert 90 is inserted within the trough 80, a minority of the pillow 10 that surrounds the trough 80 and the insert 90 has a greater rigidity than the rest of the pillow 10.

In various embodiments, the opening of the trough 80 within the bottom side 50 may have an opening of a width (in a plane extending between a point on front side 60 and a corresponding point on back side 70) which is less than a width of the trough 80 in the same plane. The opening may be deformable, such that its width may be widened to allow the insert 90 to be inserted therein. The opening, when not deformed, has a width that is less than a width of the insert 90. In some embodiments, one or both of the openings of trough 80 within left side 30 and right side 40 may have removable and/or permanent covers, such that when the covers are in palace, the insert 90 is held at substantially a same point between the left side 30 and the right side 40. In other embodiments, the trough 80 may have any other method of holding the insert 90 substantially in a same place such that the insert 90 is removable.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A therapeutic pillow kit comprising:

a pillow with a linear hollow in a shape of a prism therein; and an insert with shapes partially or wholly corresponding to said shape of said linear hollow;

wherein said insert is removably insertable into said linear hollow; and wherein said insert comprises:

an internal linear hollow in a shape of a prism; and an internal insert removably insertable into said internal linear hollow.

2. The therapeutic pillow kit of claim 1, wherein said insert comprises a ridged and/or smooth triangular and/or semi-circular prism;

wherein said insert comprises a first material and said pillow comprises a second material; and wherein a rigidity of said first material is greater than a rigidity of said second material.

3. The therapeutic pillow kit of claim 1, wherein said insert comprises substantially identical folds at each vertical cross section thereof.

4. The therapeutic pillow kit of claim 1, wherein said insert comprises a hollow portion at each vertical cross section thereof.

5. The therapeutic pillow kit of claim 1, wherein said internal insert is made of a same and/or a different material as said insert;

wherein said same internal insert is usable for multiple said inserts;

wherein, when said insert is inserted within said trough, a portion of said pillow surrounding said insert is more rigid than a rest of said pillow.

* * * * *